US007302954B1

(12) United States Patent
Shigematsu et al.

(10) Patent No.: US 7,302,954 B1
(45) Date of Patent: Dec. 4, 2007

(54) CIGARETTE FILTER COMPRISING GRAPE PROANTHOCYANIDIN

(75) Inventors: Masato Shigematsu, Sakai (JP); Tohru Shibata, Himeji (JP); Shoichi Tokutake, Noda (JP); Fumio Yamaguchi, Noda (JP); Norikazu Fujii, Noda (JP)

(73) Assignee: Daicel Chemical Industries, Ltd., Sakai-shi (JP)

( * ) Notice: Subject to any disclaimer, the term of this patent is extended or adjusted under 35 U.S.C. 154(b) by 189 days.

(21) Appl. No.: 10/110,988

(22) PCT Filed: Oct. 18, 2000

(86) PCT No.: PCT/JP00/07247

§ 371 (c)(1),
(2), (4) Date: Apr. 19, 2002

(87) PCT Pub. No.: WO01/28370

PCT Pub. Date: Apr. 26, 2001

(30) Foreign Application Priority Data

Oct. 20, 1999 (JP) ..... 11-298166

(51) Int. Cl.
*A24D 3/08* (2006.01)
*A61K 31/00* (2006.01)

(52) U.S. Cl. ..... 131/334; 131/202

(58) Field of Classification Search ..... 514/1, 514/23, 99, 100, 646, 703, 693, 694; 131/334–335, 131/331, 202
See application file for complete search history.

(56) References Cited

U.S. PATENT DOCUMENTS 3,217,719 A * 11/1965 Bell et al. ..... 131/332
3,557,801 A * 1/1971 Jamison ..... 131/342
4,124,033 A 11/1978 Zizka et al.
4,636,182 A 1/1987 Cho et al.
4,698,360 A 10/1987 Masquelier
4,797,421 A * 1/1989 Ariga et al. ..... 420/545
4,821,750 A * 4/1989 Browne ..... 131/345
5,211,944 A * 5/1993 Tempesta ..... 424/78.08
5,804,168 A * 9/1998 Murad ..... 424/59
5,829,449 A 11/1998 Hersh et al.
5,912,363 A 6/1999 Nafisi-Movaghar et al.
6,832,612 B2 * 12/2004 Zhao et al. ..... 131/334
2005/0138910 A1 * 6/2005 Rohdewald et al. ..... 55/528

FOREIGN PATENT DOCUMENTS

CN 1145206 A 3/1997
FR 2 770 228 A1 4/1999
JP 59-71677 A 4/1984
JP 60-160962 A 8/1985
JP 63-232371 A 10/1987
JP 63-237770 A 10/1988
JP 63-248380 10/1988
JP 2-138958 A 5/1990
JP 3-216178 A 9/1991
JP 3-290176 A 12/1991
JP 5-23159 A 2/1993
JP 5-115273 A 5/1993
JP 6-49053 A 2/1994
JP 6-78739 3/1994
JP 6-62824 A 6/1994
JP 11-80148 A 3/1999
WO 99/33365 7/1999

OTHER PUBLICATIONS

Oligomeric Proanthocyanidin Complexes: History, Structure, and Phytophamaceutical Applications, Fine et al. Alternative Medicine Review vol. 5 No. 2 2000.*

* cited by examiner

*Primary Examiner*—Carlos Lopez
(74) *Attorney, Agent, or Firm*—Birch, Stewart, Kolasch & Birch, LLP

(57) ABSTRACT

To a constitutive element of a tobacco (a leaf-tobacco component or a filter) is added a proanthocyanidin or a proanthocyanidin-carrying porous material (such as an active carbon) to obtain an element for tobacco smoke. The proanthocyanidin may be at least one extract selected from a grape seed or pip, a grape rind or pericarp and squeezed dregs of a grape fruit.

14 Claims, No Drawings

CIGARETTE FILTER COMPRISING GRAPE PROANTHOCYANIDIN

This application is the national phase under 35 U.S.C. § 371 of PCT International Application No. PCT/JP00/07247 which has an International filing date of Oct. 18, 2000, which designated the United States of America.

TECHNICAL FIELD

The present invention relates to a tobacco element which reduces inflow rate of a certain smoke component through an oral cavity of a smoker and which is capable of adjusting the taste and palatability according to the smoker's taste, a process for producing the element as well as a use of a proanthocyanidin.

BACKGROUND TECHNOLOGY

Recently, in the light of a trend toward so-called a lighter tobacco and an effect of a tobacco on health, various investigations have been undertaken around advanced nations to reduce an inflow rate (an amount to be delivered) of a smoke component through an oral cavity on smoking. One of methods important for the purpose is to improving a filter.

In the present tobacco smoke filter, a crimped fiber bundle (tow) of cellulose diacetate is usually used, and in order to improve the filtration efficiency, a tow having small degree of monofilament fineness, or a tow having the large amount to be charged of the fiber is often used. However, since these methods cause increase of the pressure drop (puff resistance), there is a limit to improvement of the filtration efficiency within the range of a practical pressure drop (puff resistance). Moreover, in the case where the filtration efficiency is increased using such a method, it is difficult to eliminate or remove only a specific component in smoke components selectively, that is, to discriminate the filtration ratio of each smoke component significantly. Therefore, since low-volatile smoke components are indiscriminately eliminated, a smoker does not obtain satisfaction while taste of the tobacco becomes light.

Therefore, until now, various materials or additives have been proposed for improvement of filterability of a filter. For example, as an additive for reducing an amount of nicotine to be delivered, nicotinic acid amide (Japanese Patent Application Laid-Open No. 216178/1991 (JP-3-216178A)), proteases (Japanese Patent Application Laid-Open No. 290176/1991 (JP-3-290176A)) and others have been proposed. Incidentally, since the delivery of tar also has become of interest, in many countries, there is duty of indication of tar content label in the same manner as nicotine. However, there is no report of a substance excellent in an ability of eliminating tar. Nicotine itself is a component imparting a taste to a tobacco, and is regarded as having a direct influence on satisfaction of smoking. From this viewpoint, it is considered that removing a tar component at relatively high level is preferred so as not to lose the aroma and palatability of the tobacco.

Japanese Patent Application Laid-Open No. 71677/1984 (JP-59-71677A) discloses a filter material for a cigarette containing a filter medium, and the filter medium is obtained by applying a filter medium, and the filter medium comprises a porous natural substance containing magnesium silicate as a main component and chestnut tannin singly, or optionally a coffee bean extract, a tea-leaf extract or a licorice extract, on a surface of that. Japanese Patent Application Laid-Open No. 115273/1993 (JP-5-115273A) discloses a tobacco obtained mixing epigallocatechingallate to the tobacco itself and the filter part. Moreover, Japanese Patent Application Laid-Open No. 23159/1993 (JP-5-23159A) discloses a tobacco filter containing ellagic acid. However, in the above-described filters, it is impossible to eliminate or remove a tar component effectively with keeping the aroma and palatability.

On the other hand, a free radical component in tobacco smoke has essentially extremely high reactivity so that there is possibility that the free radical component gives an undesirable influence on health. Therefore, the eliminating or removing of the free radical component becomes of interest, and some methods to enhance the filtration efficiency have been conducted (e.g., Japanese Patent Application Laid-Open No. 237770/1988 (JP-63-237770A)).

For example, Japanese Patent Application Laid-Open No. 248380/1988 (JP-63-248380A) proposes use of an active carbon. However, the active carbon is a superior adsorbent which adsorbs not only a free radical component but also many substances simultaneously. The aroma and palatability of a tobacco itself are remarkably deteriorated when the active carbon is used in large quantity. Moreover, it is considered that the active carbon itself gives a unique influence on the taste and palatability.

Japanese Patent Application Laid-Open No. 232371/1987 (JP-62-232371A) discloses a tobacco filter containing an amino acid such as tryptophan. However, a efficiency of eliminating a radical by the filter is low. Also, if the amino acid is burned, there is a problem that the amino acid produces a strong carcinogenic substance such as tryptophan pyrolysate P2.

Japanese Patent Application Laid-Open No. 78739/1994 (JP-6-78739A) discloses that active oxygen can be removed by using a filter in which a ginkgo-leaf extract is adhered or applied to a three-dimensional formed porous material (substance). Moreover, WO99/33365 discloses that a rosemary extract is effective for elimination of a free radical in a tobacco filter. However, since the rosemary extract comprises a relatively low-molecular-weight constitutive component, the extract has the unique aroma. Therefore, in the case where the extract is applied to an ordinary tobacco, the aroma, taste and palatability are sometimes deteriorated. Furthermore, the both extracts mentioned above are not satisfactory for an ability of eliminating a free radical component.

Chinese Patent Application Laid-Open No. 1145206A discloses a cigarette which comprises a filter containing polyphenol extracted from tea, vitamin C and an active carbon, and which is of a low free radical and a low toxicity. However, the filter is not satisfactory for an ability of capturing a radical.

Furthermore, in a conventional filter for tobacco smoke, an ability of selectively eliminating a tar component relative to a nicotine component and an ability of eliminating a free radical component are incompatible at high level with each other.

Therefore, an object of the present invention is to provide an element for tobacco smoke which is capable of eliminating a tar component selectively and a process for producing the same.

It is other object of the present invention to provide an element for tobacco smoke which is capable of eliminating a free radical component effectively and a process for producing the same.

It is still other object of the present invention provide an element for tobacco smoke in which an ability eliminating a tar component with high selectivity and an ability of highly eliminating a free radical component can be compatible with each other without deteriorating the aroma and palatability, and a process for producing the same.

It is another object of the present invention to provide a process for being capable of eliminating a tar component and/or a free radical component effectively.

DISCLOSURE OF INVENTION

The inventors of the present invention made intensive studies to achieve the above objects, and finally found that a use of an element for tobacco smoke containing a proanthocyanidin (one of polyphenol components derived or originated from a plant) enables to capture or trap a free radical component effectively with eliminating a tar component rather than a nicotine component selectively. The present invention was accomplished based on the above findings.

That is, an element for tobacco smoke of the present invention comprises a proanthocyanidin. For example, the proanthocyanidin may be a compound represented by the following formula (I):

(I)

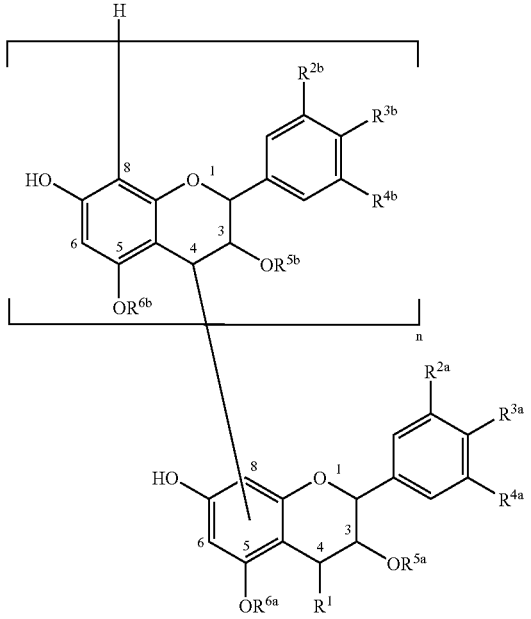

wherein $R^1$ represents hydrogen atom or hydroxyl group; $R^{2a}$, $R^{2b}$, $R^{4a}$ and $R^{4b}$ each independently represents hydrogen atom, hydroxyl group or a $C_{1-4}$alkoxy group; $R^{3a}$ and $R^{3b}$ each independently represents hydroxyl group or a $C_{1-4}$alkoxy group; $R^{5a}$, $R^{5b}$, $R^{6a}$ and $R^{6b}$ each independently represents hydrogen atom or an ester residue; and n represents an integer of not less than 1. It is preferred that the proanthocyanidin comprises a large amount of high molecular fractions. For example, a weight decrease of the proanthocyanidin is not more than 30% by weight when a membrane of cellulose having a cut-off molecular weight of 5,000 is used. The element for tobacco smoke may be comprise a proanthocyanidin in a manner that the proanthocyanidin is supported or carried by a carrier (e.g., a porous material (or substance) such as an active carbon). A source of the proanthocyanidin is not limited particularly, and is usually a plant, for example, may be a grape extract (such as a grape seed or pip, a grape rind or pericarp and squeezed dregs of a grape fruit). With regard to an element for tobacco smoke such as a cigarette and others, usually it is sufficient for a constitutive element of a tobacco (such as a tobacco smoke filter) to contain the proanthocyanidin.

The element for tobacco smoke of the present invention can be produced by adding a proanthocyanidin to an element (such as a constitutive element of a tobacco). Moreover, the present invention includes a use of a proanthocyanidin in order to eliminate a tar component or a free radical component from tobacco smoke by bringing the tobacco smoke into contact with the proanthocyanidin.

BEST MODE FOR CARRYING OUT THE INVENTION

The element for tobacco smoke of the present invention comprises a variety of elements for treating tobacco smoke, for example, various elements constituting a rod-shaped tobacco [such as a leaf component of a tobacco (a cigar, a cigarette) and a tobacco smoke filter], and a proanthocyanidin which is added to the above-mentioned element(s) in order to eliminate a specific component in tobacco smoke effectively.

[Proanthocyanidin]

A proanthocyanidin is a group of a compound (a condensed tannin) in which flavan-3-ol or flavan-3,4-diol is contained as a constitutive unit and the constitutive units are bonded to each other by condensation or polymerization at 4-6 position, 4-8 position, etc. The proanthocyanidin is represented by the following formula (II). Incidentally, the following formula (II) shows a compound obtained by condensation or polymerization at 4-8 position as one example and omits a compound obtained by condensation or polymerization at 4-6 position.

(II)

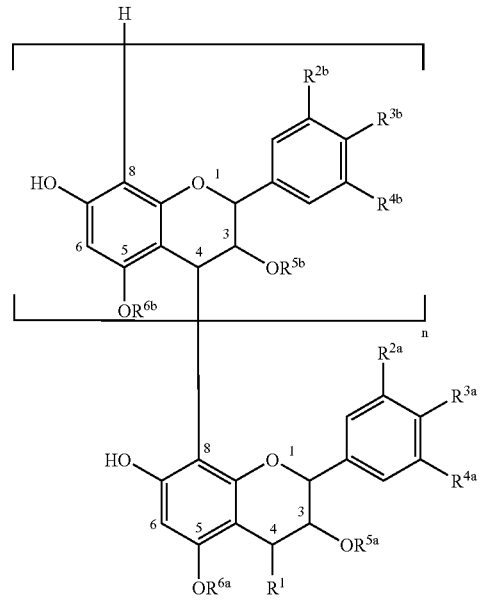

wherein $R^1$ represents hydrogen atom or hydroxyl group; $R^{2a}$, $R^{2b}$, $R^{4a}$ and $R^{4b}$ each independently represents hydrogen atom, hydroxyl group or a $C_{1-4}$alkoxy group; $R^{3a}$ and $R^{3b}$ each independently represents hydroxyl group or a $C_{1-4}$alkoxy group; $R^{5a}$, $R^{5b}$, $R^{6a}$ and $R^{6b}$ each independently represents hydrogen atom or an ester residue; and n represents an integer of not less than 1.

In the above formulas (I) and (II), the $C_{1-4}$alkoxy group includes methoxy, ethoxy, butoxy group, and others, and is usually methoxy group. The ester residue represented by $R^{5a}$, $R^{5b}$, $R^{6a}$ and $R^{6b}$ includes an acyl group which may have a hydroxyl group, for example, a benzoyl group which may have a hydroxyl group (such as benzoyl group, hydroxybenzoyl group and galloyl group); a cinnamoyl group which may have a hydroxyl group [such as cinnamoyl group, coumaryl group (coumaric acid residue) and caffeyl group (caffeic acid residue)]; a glycopyranosyl group (such as glycosyl group, galactosyl group, rhamnosyl group, mannosyl group, fructosyl group and sorbosyl group), and others.

It is sufficient that n is an integer of not less than 1. The number n is usually about 1 to 50, and preferably about 1 to 20.

In the compounds represented by the above formulas (I) and (II), usually $R^1$ is hydrogen atom; $R^{2a}$, $R^{2b}$, $R^{4a}$ and $R^{4b}$ each independently is hydrogen atom, hydroxyl group or methoxy group; $R^{3a}$ and $R^{3b}$ each independently is hydroxyl group or methoxy group. Moreover, $R^{5a}$, $R^{5b}$, $R^{6a}$ and $R^{6b}$ each independently is usually hydrogen atom, galloyl group or a glycopyranosyl group.

The name of "proanthocyanidin" originates from the reason that a proanthocyanidin produces an anthocyanidin such as cyanidin, delphinidin and pelargonidin by being subjected to acidic treatment. Moreover, the proanthocyanidin includes, for example, procyanidin, prodelphinidin and propelargonidin, such as dimer, trimer, tetramer, pentamer (5-mer) to nonamer (9-mer) and further polymer [decamer (10-mer) to triacontamer (30-mer) or more] of the above-mentioned constitutive unit. Also, the proanthocyanidin includes a stereoisomer thereof.

In a purifying step in which an extract containing the proanthocyanidin is subjected to fractionation using a membrane of cellulose having a cut-off molecular weight of 5,000, it is preferred that a weight decrease of the extract is not more than 30% by weight, preferably not more than 20% by weight and further preferably not more than 10% by weight, because the extract has high molecular weight, as a result the extract tends to form a matrix having noncrystalline structure and has high reactivity with a molecule in gas phase (e.g., a free radical component).

Incidentally, a compound of the formula (I) wherein n is 0, such as (gallo)catechin, epi(gallo)catechin, may be contained as far as effects of the proanthocyanidin are not deteriorated.

Moreover, even if the proanthocyanidin is taken orally, it is safe. Furthermore, it is considered the proanthocyanidin is not only safe but also so favorable for health and it is regarded as a cause of "French paradox". That is, it is considered that the antioxidative action of the proanthocyanidin contained in red wine which the French drink willingly prevents arteriosclerosis. That is the reason the French do not easily suffer from arteriosclerosis although they often eat meat.

Moreover, among phenolic compounds, the proanthocyanidin particularly has high density of an active group per molecule as well as has the strong antioxidative action. Therefore, an element for tobacco smoke can capture or trap (or catch) a free radical component in tobacco smoke remarkably by adding the proanthocyanidin to the element for tobacco smoke. Specifically, a tobacco smoke filter has a good efficiency of capturing or trapping a radical in tobacco smoke. For example, in a constitutive element of a tobacco, particularly a filter (2.0 cm length, 7.8 mmϕ in diameter), comprising 0.1 to 15% by weight [preferably 0.5 to 15% by weight (e.g., 1 to 15% by weight) and more preferably 2 to 15% by weight] of the proanthocyanidin, when tobacco smoke is passed through the constitutive element of the tobacco under the condition of a rate of air flow of 17.5 ml/second, an efficiency of capturing a radical in tobacco smoke is, for example, 30% or more (e.g., 35 to 100%), preferably 50% or more (e.g., 55 to 100%) and more preferably 60% or more (e.g., 70 to 100%) in the case of measurement with use of an electron spin resonance equipment by a method described in the Examples mentioned below. Thus, the free radical component in tobacco smoke can be eliminated effectively even when the tobacco smoke is passed through such a short tobacco filter of about 2 cm length in extremely short time.

Furthermore, because the proanthocyanidin comprises a high concentration of phenol residue, it has a high affinity for a phenol component contained in tar in tobacco smoke, as a result a rate of eliminating tar rather than nicotine from tobacco smoke can be improved. Specifically, in a tobacco smoke filter containing the proanthocyanidin, a ratio of eliminating tar relative to nicotine in tobacco smoke (filtration rate of tar/filtration rate of nicotine) is not less than 1.2 (e.g., 1.2 to 2), preferably not less than 1.3 (e.g., 1.3 to 1.7).

[Extraction Method of Proanthocyanidin]

In a proanthocyanidin which is used in the present invention, a source of raw material thereof, a part to be used of raw material thereof, producing method thereof and purifying method thereof are not limited particularly. For example, the proanthocyanidin may be derived or originated from a plant such as a fruit (e.g., a fruit, a rind or pericarp and a seed or pip of a grape, a persimmon and an apple), a bark (e.g., a bark of a pine) and a legume and a grain (e.g., a soybean, an adzuki bean), a juice squeezed from the above plant and dregs thereof, as well as a food and a drink derived from the above plant (e.g., a fruit wine such as wine and apple wine, a fruit juice). Among them, a grape, for example a grape seed or pip, a grape rind or pericarp and squeezed dregs of a grape fruit is preferable as a raw material of the proanthocyanidin. Because these raw materials are usually treated as a waste, they are cost-efficient. Particularly, since the grape pip comprises a large amount of a proanthocyanidin, and only a little contaminant such as a saccharide, the proanthocyanidin having high purity can be easily obtained in great quantity by extraction. Moreover, the proanthocyanidin obtainable from the grape pip comprises a larger amount of high molecular fraction and has a better effect of radical reduction than a proanthocyanidin obtainable from other raw materials such as a bark of a pine and a fruit of an apple.

A method for extracting the proanthocyanidin from the grape seed or pip, the grape rind or pericarp and squeezed dregs of the grape fruit includes an efficient extraction method using water or hydrated alcohol described in Japanese Patent Application Laid-Open No. 200781/1991 (JP-3-200781A), Japanese Patent Application Laid-Open No. 80148/1999 (JP-11-80148A) and others.

As a method for obtaining a proanthocyanidin other than an extraction from the grape pip, it is known that an extraction from an adzuki bean (Ariga et al., Agricultural Biological Chemistry (Agric. Biol. Chem.) vol. 45, p 2709-2712, 1981), an extraction from a bark of a pine (R. W. Hemingway et al., Phytochemistry vol. 22, p 275-281, 1983), a separation from an apple wine (A. G. H. Lea et al., Journal of the Science of Food and Agriculture (J. Sci. Food.

Agric.) vol. 29, p 471-477, 1978), a chemical synthesis (G. Fonknechten et al., Journal of Institute Brewing (J. Inst. Brew.) vol. 89, p 424-431, 1983) and others.

The extracted proanthocyanidin can be obtained in a liquid form or a semi-solid form, and can be used as a proanthocyanidin-containing condensate or a dried proanthocyanidin by removing an extracting solvent from the extract solution with use of a known method such as vacuum distillation, spray-drying and lyophilization. Moreover, as shown in the Examples of Japanese Patent Application Laid-Open No. 80148/1999 (JP-11-80148A), by using the most suitable raw material and extraction condition, a proanthocyanidin composition having high purity of 90% by weight or more can be obtained easily.

Incidentally, as mentioned above, the proanthocyanidin has a different content thereof depending on the raw material or the extraction process. A mixture comprising 10% by weight or more of the proanthocyanidin (preferably 30% by weight or more, further preferably 50% by weight or more) can be used. The content of the proanthocyanidin can be measured by various methods, for example, vanillin-hydrochloric acid method (R. B. Broadhurst et al., J. Sci. Food. Agric., vol. 29, p 788-794, 1978) considered to be specific to a catechin residual structure.

[Element for Treating Tobacco Smoke (Such as a Constitutive Element of a Tobacco)]

A typical example of an element comprising the proanthocyanidin for treating tobacco smoke with filtration includes a constitutive element of a tobacco (e.g., a leaf-tobacco, a tobacco smoke filter, and a porous material (or substance) such as an adsorbent). In the tobacco smoke filter, such a tobacco with the tobacco filter that the tobacco smoke filter is attached at a mouth contacts (mouth-contacting portion) of a leaf-tobacco component is the most popular manner for use of the tobacco filter, however, a manner for use of the filter is particularly not limited. That is, in the specification, the term "a tobacco smoke filter (or a filter for tobacco smoke)" refers to a variety of filters that filtrate tobacco smoke and includes for example a filter built-in pipe, a filter provided in an air cleaner and others.

(Leaf-Tobacco)

A leaf-tobacco may be either of a cigarette or a cigar, and is effectively applied to a cigarette that a tobacco-leaf such as a shredded- (or cut-) tobacco is shaped into a rod-form with use of a wrapping paper. A leaf-tobacco component (portion or section) of a cigarette (the body of the tobacco) may constitute a whole cigarette which is not provided with a tobacco smoke filter.

(Tobacco Smoke Filter)

A tobacco smoke filter attached to a mouth-contacting portion of a leaf-tobacco component may comprise a fiber or a granule (powder or particle) of a conventional filter material such as a cellulose (e.g., wood pulp and linter pulp which may be fibrillated), a regenerated cellulose (e.g., viscose rayon and cupro-ammonium rayon), a cellulose ester, a synthetic polymer (e.g., a polyester, a polyurethane, a polyamide and a polyolefin), and others. The fiber or a granule (powder) can be used singly or in combination thereof.

The preferred filter material includes at least one member selected from a cellulose fiber, a cellulose ester fiber and a polypropylene fiber, and in most cases, the filter material includes at least a cellulose ester fiber in order to improve the taste and palatability. Exemplified as the cellulose ester fiber is, for example, an organic acid ester such as cellulose acetate, cellulose propionate and cellulose butyrate (e.g., an ester of cellulose with an organic acid having about 2 to 4 carbon atoms); a mixed organic acid ester such as cellulose acetate propionate and cellulose acetate butyrate; and a cellulose ester derivative such as a polycaprolactone-grafted cellulose ester, and others. The cellulose ester fiber also can be used singly or in combination thereof.

The preferred cellulose ester includes, for example, cellulose acetate, cellulose propionate, cellulose butyrate, cellulose acetate propionate and cellulose acetate butyrate, particularly, cellulose acetate.

The average polymerization degree (viscosity-average polymerization degree) of the cellulose ester may be selected from the range of for instance about 50 to 900 and preferably about 200 to 800. The average substitution degree of the cellulose ester may be selected from the range of for instance about 1.5 to 3.0.

The cross-sectional configuration of the fiber is not particularly restricted but may for example be circular, elliptical or any other configuration. Thus, the fiber may be of modified cross-section (e.g. Y-, X-, I-, R- or H-configuration) or hollow.

The diameter and length of the fiber can be selected according to a species of fiber. In most cases, the diameter of the fiber is selected from for instance about 0.01 to 100 μm, preferably about 0.1 to 50 μm (e.g., about 1 to 30 μm), and the length of the fiber is selected from about 50 μm to 5 cm, preferably about 100 μm to 3 cm. The fineness of the cellulose ester can be selected within the range of about 1 to 16 deniers and preferably about 1 to 10 deniers. The fiber such as a cellulose ester fiber may be whichever of a non-crimped fiber or a crimped fiber.

The fiber can be used in the form of a tow (fiber bundle) obtained or formed by bundling about 3,000 to 100,000 monofilaments (filament), preferably about 3,000 to 30,000 monofilaments (filament) of a cellulose ester fiber.

A tobacco smoke filter formed by a filter material may comprise a conventional binder component in order to give temperate hardness to a filter rod. The binder component to be used includes a plasticizer (e.g., triacetin), a resin (a water soluble polymer or a water insoluble polymer, selected from a natural polymer, a semisynthetic polymer and a synthetic polymer), a polysaccharide (such as a starch and a starch derivative), according to the species of fiber. The resin can be used in a liquid form or semi-solid form such as solution and dispersion, in a solid form such as granule (powder) and fiber, in the form of a melt, and others.

The tobacco smoke filter has a pressure drop (puff resistance) and density in the ranges not adversely affecting the characteristics of the filter. For example, in a filter having a length of 12 cm and diameter of 7.8 mmϕ, the pressure drop (puff resistance) is about 200 to 600 mm WG (water gauge) and preferably about 300 to 500 mm WG, and the density is, for instance, about 0.20 to 0.50 g/cm$^2$, and preferably about 0.25 to 0.45 g/cm$^2$ (e.g. about 0.30 to 0.45 g/cm$^2$), in many cases.

In the case where a leaf-tobacco or a filter is used as a constitutive element of a tobacco, the content of the proanthocyanidin can be for instance selected within the range of about 1 to 50 parts by weight, preferably about 2 to 30 parts by weight (e.g., about 5 to 30 parts by weight), relative to 100 parts by weight of the constitutive element of a tobacco (the leaf-tobacco or the filter) according to desired amount of a smoke component to be delivered, etc., and is usually 5 to 20 parts by weight. In the case where the amount of the proanthocyanidin to be added is less than 1 part by weight, an ability of eliminating a toxic component in a main stream of tobacco smoke is low. On the other hand, in the case where the amount of the proanthocyanidin to be added is more than 50 parts by weight, the pressure drop (puff resistance) tends to rise.

Among constitutive elements of a tobacco, the proanthocyanidin is usually contained in a tobacco smoke filter.

(Porous Material (or Substance))

The proanthocyanidin may be added to the constitutive element of the tobacco directly, or may be added by carrying (containing in or staining) the proanthocyanidin on a carrier such as a porous material (or substance).

The combination of the porous material and the proanthocyanidin can enhance multiplicatively an ability of eliminating a tar component and a free radical component, even when the amount of the proanthocyanidin is small. In the case of using in combination with the porous material, the proanthocyanidin is usually used by being adhered to, adsorbed to, carried on, or mixed with, the porous material. A species of porous material is not particularly restricted. The porous material includes an active carbon, silica gel, alumina, zeolite, silica, silica-alumina, cellulose particle, cellulose acetate particle, clay, sintered volcanic ash, starch particle, and others, and a carrier having large specific surface area is preferred. Usually, the porous material can be used in the form of granule (powder). The porous material can be used singly or in combination thereof.

The preferred porous material includes the active carbon which has been widely used as an additive of a tobacco smoke filter. In the case of using the active carbon, the active carbon and the proanthocyanidin act multiplicatively, so that more remarkable ability of capturing a free radical is realized.

The specific surface area of the porous material can be selected from the widely range of not adversely affecting the activity of the proanthocyanidin, for instance, about 1 to 10,000 $m^2/g$ (e.g., about 10 to 10,000 $m^2/g$), preferably about 300 to 3,000 $m^2/g$ (e.g., about 400 to 2,000 $m^2/g$). The average particle size of the porous material can be, for example, selected within the range of about 1 to 2,000 μm, preferably about 5 to 1,000 μm (e.g., about 10 to 500 μm.

The amount of the proanthocyanidin to be adhered or carried to the porous material is, relative to 100 parts by weight of the porous material, about 0.1 to 50 parts by weight of the proanthocyanidin (e.g., about 1 to 50 parts by weight), preferably about 1 to 30 parts by weight and more preferably about 2 to 20 parts by weight (e.g., 2 to 10 parts by weight).

The porous material comprising the proanthocyanidin may be used as it stands in order to treat tobacco smoke with filtration, or may be used as being added to the leaf-tobacco or filter, or being filled in space between a plurality of filters with the proanthocyanidin.

In the case of adding the proanthocyanidin to the constitutive element of the tobacco (a leaf-tobacco or a filter), the amount of the proanthocyanidin-carrying porous material to be added can be selected in association with a species or a used form of proanthocyanidin, etc., and is about 0.1 to 25 parts by weight, preferably about 0.5 to 20 parts by weight (e.g., about 1 to 10 parts by weight) in terms of a proanthocyanidin, relative to 100 parts by weight of the constitutive element of the tobacco (a leaf-tobacco or a filter). When the amount of the proanthocyanidin-carrying porous material to be added is small, an efficiency of eliminating a tar component or a free radical component in tobacco smoke is adversely affected. On the other hand, when the amount of the proanthocyanidin-carrying porous material to be added is too large, there has a propensity for deterioration of the taste and palatability or of working efficiency on making the filter.

A method for carrying the proanthocyanidin to the porous material is not particularly restricted. For example, the method can include a method which comprises adhering, soaking or adsorbing a solution composed of the proanthocyanidin (a solution of a solvent such as water and an alcohol) to the porous material with use of a process such as spraying and soaking, and then evaporating the solvent; a method which comprises adding the porous material to a solution composed of the proanthocyanidin to adsorb the proanthocyanidin to the porous material, and then removing an excess solvent, and evaporating to dryness; and others.

The proanthocyanidin or the carrying porous material may be distributed (scattered) over the whole element (such as a constitutive element of a tobacco) uniformly, non-uniformly, or may be partially uniform. For instance, in a tobacco smoke filter having a structure such as dual filter and triple filter, the proanthocyanidin or the proanthocyanidin-carrying porous material may be filled a gap between a plurality of filter tips.

The constitutive element of the tobacco may comprise a variety of additives, for example, a binder for improving hardness; a flavor; a whitening agent (such as a titanium oxide, preferably an anatase-form titanium oxide); a fine powder of inorganic substance such as kaolin, talc, diatomaceous earth, quartz, calcium carbonate, barium sulfate, titanium oxide and alumina; a thermal stabilizer such as a salt of an alkaline metal, a salt of an alkaline earth metal; a colorant; an oil; a yield improver; an adsorbent such as activated carbon; a biodegradation accelerator; a photodegradation accelerator; and others.

[Process for Producing an Element for Tobacco Smoke]

In the present invention, an element for tobacco smoke is produced by adding the proanthocyanidin to the above element (an element for treating tobacco smoke). As mentioned above, the proanthocyanidin may be added to the element directly, or may be added by carrying the proanthocyanidin on a carrier such as a porous material. In the constitutive element of the tobacco, usually, a method of adding the proanthocyanidin or the proanthocyanidin-carrying porous material to the tobacco smoke filter may be adopted. Incidentally, the proanthocyanidin or the proanthocyanidin-carrying porous material is sometimes named "a proanthocyanidin component".

A form of adding or a method for adding a proanthocyanidin component is not particularly restricted. For example, the proanthocyanidin in the form of powder or particle, or the proanthocyanidin-carrying porous material can be added by utilizing a charcoal-adding apparatus used for production of a tobacco smoke charcoal filter as it stands. A liquid proanthocyanidin or dispersion in which the proanthocyanidin-carrying porous material is dispersed (such as slurry) can be added to an element (such as a leaf-tobacco and a filter) by a method such as sprinkling with use of spray, etc., coating (applying) and soaking. Moreover, the proanthocyanidin may be comprised in a fiber by adding and mixing the proanthocyanidin to a fiber material (dope) at spinning step to mix-spinning, or may be adhered to a fiber surface at a suitable step after spinning step.

More specifically, for example, a leaf-tobacco component (or portion or section) can be obtained by a method of mixing a granule (powder) proanthocyanidin component and a leaf-tobacco to be made up into a rod-form with use of a wrapping paper, a method of spraying solution or dispersion (such as slurry) of the proanthocyanidin component to the leaf-tobacco, made up into a tobacco column with use of a wrapping paper, and then removing the solvent. Incidentally, the leaf-tobacco made up (shaped) into a rod-form is optionally cut in given length.

Moreover, the tobacco smoke filter can be produced by making up a filter material into a rod-form with use of a wrapping paper while adding the proanthocyanidin component, and optionally a binder component, to it. For instance, when a fiber is used as a filter material, the tobacco filter can be produced by opening the fiber bundle (tow) in the width of about 5 to 50 cm and making it up into a rod-form with use of the wrapping paper while adding the proanthocyanidin component, and optionally the binder component, to the filter material. Moreover, the filter can be also obtained by adding the proanthocyanidin component or optionally the binder component, forming the filter into a sheet-form like paper with use of web process and others, and then optionally creping or embossing the obtained sheet, and making up the sheet into a rod-form. In most cases, the rod-form filter made up is usually cut in given length and made a filter tip.

Incidentally, in order to reduce an amount of a tar component or free radical component to be delivered more effectively, a combustion rate of the leaf-tobacco component may be adjusted (or retarded), or the tobacco smoke filter may use in combination with a filter having ventilative function.

The proanthocyanidin shows a superior ability of eliminating a tar component rather than a nicotine component, as described above. Moreover, the proanthocyanidin has a good ability of capturing a free radical component. Thus, in other embodiment of the present invention, the proanthocyanidin is used for eliminating a tar component and/or a free radical component by bringing tobacco smoke into contact with the proanthocyanidin.

INDUSTRIAL APPLICABILITY

The element for tobacco smoke of the present invention comprises a proanthocyanidin, thus has an ability of highly selectively eliminating a tar component rather than a nicotine component in tobacco smoke, and moreover, has a good ability of capturing a free radical component. Therefore, the element for tobacco smoke of the present invention enables to eliminate a toxic component effectively without deteriorating the aroma and palatability. Furthermore, since the proanthocyanidin is derived from a natural compound, the element for tobacco smoke of the present invention has good safety and is advantageous economically.

EXAMPLES

The following examples and comparative examples are intended to describe a tobacco smoke filter, which is one of an element for tobacco smoke of this invention, in further detail and should by no means be construed as defining the scope of the invention.

Incidentally, with respect to the tobacco smoke filter sample in the examples and comparative examples, measurement of a pressure drop (puff resistance), measurement of a filtration rate of nicotine and tar, quantitative analysis of radical with use of an electron spin resonance measurement, and quantitative analysis of proanthocyanidin were conducted according to the following methods.

[Pressure Drop (Puff Resistance)]

A pressure drop (mm WG) in the case where air was passed through the tobacco filter sample at a rate of air flow of 17.5 ml/second was measured by using an automatic pressure drop measuring instrument (manufactured by Filtrona Instruments & Automation Ltd., Automatic Test Stations FTS300).

[Filtration Rate of Nicotine and Tar]

To the tobacco smoke filter sample is connected a leaf-tobacco component of a tobacco (manufactured by Japan Tobacco Inc., Co., Peace Light), and the obtained tobacco sample was subjected to smoking with use of a piston-type constant volume type automatic smoking instrument (manufactured by Heinr. Borgwaldt GmbH, RM20/CS) at a flow rate of 17.5 ml/second for a smoking period of 2 seconds/time with a smoking frequency of once per minute. Nicotine and tar in smoke passed through the filter were collected by a glass fiber filter (Cambridge filter), the amount of nicotine was measured by using gas chromatograph (Hitachi, Ltd., G-3000), and the amount of tar was determined based on the weight increase of the Cambridge filter after smoking.

On the other hand, the amounts of nicotine and tar adhered to the tobacco smoke filter also were measured in the same manner.

The filtration rates of nicotine and tar were estimated based on the following formulas, wherein Tn and Tt represent the amounts of nicotine and tar, respectively, each adhered to the tobacco smoke filter, and Cn and Ct represent the amounts of nicotine and tar, respectively, each adhered to the Cambridge filter.

$$\text{The filtration rate of nicotine}(\%)=100\times Tn/(Tn+Cn)$$

$$\text{The filtration rate of tar}(\%)=100\times Tt/(Tt+Ct)$$

Furthermore, the value of the filtration rate of tar divided by the filtration rate of nicotine was calculated, and the rate of eliminating tar was compared with that of eliminating nicotine. As the value of the sample is larger, a relative ability of eliminating tar rather than nicotine is superior.

[Electron Spin Resonance (ESR) Measurement]

To the tobacco smoke filter sample is connected a leaf-tobacco component of a tobacco (manufactured by Japan Tobacco Inc., Co., Peace), and the obtained tobacco sample was attached to a suction apparatus. Then, the tobacco was lighted and smoked by the pump. The smoking step was conducted for 5 seconds (at a flow rate of 17.5 ml/second) at 30-second intervals and one piece of a cigarette was finished burning out in 8 to 9 times of the smoking step. Tobacco smoke was conducted to 5 ml of 10 mM phosphate buffer solution (PBS) containing 0.9 wt. % of NaCl in a gas washing bottle. After completion of burning out, 200 μL of PBS through which tobacco smoke was passed was taken out and thereto was added 5 μL of DMPO (5,5-dimethyl-1-pyrroline-N-oxide) as a spin trap agent. The solution was introduced into a flat quartz cell for electron spin resonance (ESR) measurement, and the cell was attached to an ESR apparatus (manufactured by JEOL Ltd., FR-30). The measurement conditions were shown as follows.

Magnetic field: 329.8 mT, Output: 4.0 mW, Oscillation frequency: 9.425 GHz, Sweep width: 5.0 mT, Time coefficient (Sweep time): 1.0 min., Modulation width: 0.079 mT, Amplification factor: ×1,000, Time constant: 0.1.

The signal obtained by the measurement was subjected to analysis using an analysis software "ESR data analyzer" manufactured by Labotech.

In ESR signal of spin adduct of radical accrued from tobacco smoke and DMPO, a peak having g value of nearby 2.02 was subjected to multiple integral, and the area ratio of the peak to an internal standard signal was calculated. The ratio was employed as the index of quantity of radical. The rate of capturing radical was calculated according to the following formula.

The rate of capturing radical=100−(the amount of measured radical×100)/(the quantity of radical measured in Comparative Example 1)

Each of the above-mentioned measurements was conducted after the filter connected to the tobacco was allowed to stand for 24 hours or more at 23° C. under 65% of the relative humidity.

[Quantity of Proanthocyanidin]

The quantity of the proanthocyanidin was determined according to the method described in the above-mentioned R. B. Broadhurst et al (J. Sci. Food. Agric., vol. 29, p 788-794, 1978). That is, to a proanthocyanidin-containing sample was added methanol solution containing vanillin and stirred well. Concentrated hydrochloric acid was immediately added thereto, and stirred still more enough. Thereafter, the mixture was allowed to stand for 15 minutes at room temperature to produce a red proanthocyanidin-vanillin conjugate. The amount of the proanthocyanidin in the conjugate was determined from the visible light absorbance at 500 nm of based on that obtained from (+)-catechin (manufactured by Sigma Chemical Co.) as a standard. If the proanthocyanidin is given as solution, the solid in an extract solution was weighted and calculated after lyophilization of the whole solution, or after measuring the amount of the whole extract solution accurately, taking out a certain amount (usually, 5 ml) of the solution, subjecting to drying by heating at 88° C. for 1.5 hours, further heating at 110° C. for 2 hours, and then cooling down for 1 hour in a desiccator.

Example 1

A cellulose diacetate fiber bundle (tow) (total denier of 36,000) composed of 3.0 denier filaments having cross-sectional Y-configuration was opened to a width of about 25 cm by using a rod-making machine for tobacco smoke filter (manufactured by Hauni Mashinenbau AG, AF2/KDF2), and on the tow was sprayed a proanthocyanidin derived from a grape pip in amount of 12% by weight of the proanthocyanidin relative to the cellulose acetate fiber, wherein the proanthocyanidin was produced by the method described in Japanese Patent Application Laid-Open No. 80148/1999 (JP-11-80148A) (purity: 95% by weight, manufactured by Kikkoman Co., trade name: Gravinol S). Then, the tow was provided to a rod making section of the machine said above, and made up at 400 m/minute with use of a wrapping paper. The obtained filter rod was cut to 120 mm in length. Furthermore, the filter rod was cut to 20 mm in length with use of a cutter to obtain a tobacco smoke filter sample. The properties of the obtained filter sample were determined by the above-mentioned methods. The results are shown in Table 1.

Example 2

To a cellulose diacetate fiber bundle (tow) (total denier of 36,000) composed of 3.0 denier filaments having cross-sectional Y-configuration was uniformly sprayed a solution obtained by dissolving 1 g of a proanthocyanidin (Gravinol S) in 300 ml of a mixed solvent of water and ethanol (water/ethanol=1/2 (volume ratio)), and air-dried for 24 hours. The resultant cellulose acetate fiber bundle (tow) was made to a filter rod of 120 mm in length by using a rod making machine for manufacturing tobacco smoke filter (AF2/FR4). The content of the proanthocyanidin relative to the cellulose acetate fiber in the filter was 1.5% by weight. Furthermore, the filter rod was cut to 20 mm in length with use of a cutter to obtain a tobacco smoke filter sample. The properties of the obtained filter sample were determined by the above-mentioned methods. The results are shown in Table 1.

Comparative Example 1

A filter sample comprising cellulose acetate fiber alone was produced in the same manner as Example 1 except that the proanthocyanidin was not added, and the above-mentioned measurements were conducted. The results are shown in Table 1.

Comparative Example 2

A sample was prepared in the same manner as Example 1 except that to a cellulose acetate fiber was added 40% by weight of an active carbon (manufactured by Takeda Chemical Industries, Ltd., active carbon "SHIRASAGI") instead of the proanthocyanidin, and the above-mentioned measurements were conducted. The results are shown in Table 1.

TABLE 1

| | Examples | | Comparative Examples | |
|---|---|---|---|---|
| | 1 | 2 | 1 | 2 |
| Pressure drop of tip (mmWG) | 55 | 55 | 55 | 60 |
| Filtration rate of tar | 48.1% | 46.5% | 41.7% | 51.4% |
| Filtration rate of nicotine | 34.8% | 33.9% | 33.1% | 47.7% |
| Filtration rate of tar/ Filtration rate of nicotine | 1.38 | 1.37 | 1.26 | 1.08 |
| Radical capturing rate | 74% | 56% | 0% | 55% |

Example 3

Each sample was prepared by connecting a leaf-tobacco component of a tobacco (manufactured by Japan Tobacco Inc., Co., trade name: Mild Seven) to each filter obtained from Example 1 and Comparative Example 1. Smoking sensory test was conducted by using the obtained samples. As a result, eight among ten panelists (panellers) estimated that the sample of Example 1 was preferable to that of Comparative Example 1 due to mildness of the taste. On the other hand, according to measurements of filtration rates of nicotine and tar, the ratio of eliminating (filtrating) rate of tar relative to that of nicotine increased by using the filter to which was added the proanthocyanidin. Such a increased ratio seems to be the reason for good estimation in the smoking sensory test.

Example 4

To the filter of 20 mm in length prepared in Comparative Example 1 was injected or poured a proanthocyanidin (Gravinol S) dissolved in a mixed solvent of water and ethanol (water/ethanol=1/1 (volume ratio)) in amount of 10% by weight of the proanthocyanidin relative to the cellulose acetate fiber, and subjected to evaporating to dryness for one day in a desiccator containing silica gel, and allowed to stand for one day under an air condition of 65%

RH at 25° C., and then the radical capturing rate was measured. The results are shown in Table 2.

Comparative Example 3

A sample was prepared in the same manner as Example 4 except that to the cellulose acetate fiber was injected a (+)-catechin (manufactured by Funakoshi Co., Ltd.), instead of the proanthocyanidin, dissolved in a mixed solvent of water and ethanol (water/ethanol=1/1 (volume ratio)) in amount of 10% by weight of the catechin relative to the cellulose acetate fiber, and the radical capturing rate was measured. The results are shown in Table 2.

Comparative Example 4

A sample was prepared in the same manner as Example 4 except that to the cellulose acetate fiber was injected a vitamin C (L-ascorbic acid, manufactured by Kishida Chemical Co., Ltd.), instead of the proanthocyanidin, dissolved in water in amount of 10% by weight of the vitamin C relative to the cellulose acetate fiber. The results are shown in Table 2.

Comparative Example 5

A sample was prepared in the same manner as Example 4 except that to the cellulose acetate fiber was injected a vitamin E (DL-α-tocopherol, manufactured by Kishida Chemical Co., Ltd.), instead of the proanthocyanidin, dissolved in methanol in amount of 10% by weight of the vitamin E relative to the cellulose acetate fiber. The results are shown in Table 2.

TABLE 2

| | Radical capturing agent | Radical capturing rate |
|---|---|---|
| Example 4 | proanthocyanidin (Gravinol S) | 68% |
| Comparative Example 1 | without additives | 0% (standard) |
| Comparative Example 3 | (+)-catechin | 39% |
| Comparative Example 4 | vitamin C | 10% |
| Comparative Example 5 | vitamin E | 2.5% |

Example 5

A sample was prepared in the same manner as Example 1 except that on the tow was sprayed a grape pip extract (proanthocyanidin content: 40% by weight, manufactured by Kikkoman Co., Gravinol N), instead of the proanthocyanidin, in amount of 12% by weight of the extract relative to the cellulose acetate fiber, and the radical capturing rate was measured. The results are shown in Table 3.

Comparative Example 6

A sample was prepared in the same manner as Example 1 except that on the tow was sprayed a tea extract (polyphenol content: 60% by weight or more, manufactured by Taiyo Kagaku Co., Ltd., SUNFLAVON HG), instead of the proanthocyanidin, in amount of 12% by weight of the extract relative to the cellulose acetate fiber, and the radical capturing rate was measured. The results are shown in Table 3.

Comparative Example 7

A sample was prepared in the same manner as Example 1 except that on the tow was sprayed a ginkgo-leaf extract (polyphenol content: 30% by weight or more, manufactured by Tokiwa Phytochemical Co., Ltd., Ginkgonon 24), instead of the proanthocyanidin, in amount of 12% by weight of the extract relative to the cellulose acetate fiber, and the radical capturing rate was measured. The results are shown in Table 3.

Comparative Example 8

A sample was prepared in the same manner as Example 1 except that on the tow was sprayed a rosemary extract [an extract extracted from a methanol-soluble ingredient of "RM-21A" (manufactured by Tokyo Tanabe Co., Ltd.) to come to 70% by weight or more of the polyphenol content in the extract], instead of the proanthocyanidin, in amount of 12% by weight of the extract relative to the cellulose acetate fiber, and the radical capturing rate was measured. The results are shown in Table 3.

TABLE 3

| | Radical capturing agent | Radical capturing rate |
|---|---|---|
| Example 5 | grape pip extract | 65% |
| Comparative Example 6 | tea extract | 22% |
| Comparative Example 7 | ginkgo-leaf extract | 30% |
| Comparative Example 8 | rosemary extract | 48% |

As apparent from the results in Table 3, although the proanthocyanidin (polyphenol) content of the grape pip extract used in Example 5 was smaller than that of the tea extract in Comparative Example 6 or that of the rosemary extract in Comparative Example 8, the grape pip extract showed higher radical capturing rate than that of the tea extract or the rosemary extract. Moreover, even when the grape pip extract was compared with the ginkgo-leaf extract in Comparative Example 8, the radical capturing rate relative to the polyphenol content was extremely high. Therefore, the proanthocyanidin in the grape pip extract have superior radical capturing property compared with other polyphenol compounds.

Example 6

Seventy grams (70 g) of a proanthocyanidin (Gravinol S) was dissolved in aqua solution 700 ml containing 10% by weight of ethanol, to the solution was added 70 g of an active carbon (manufactured by Takeda Chemical Industries, Ltd., active carbon "SHIRASAGI"), and the mixture was stirred for one day at room temperature. The mixture was filtrated with use of a No. 4 glass filter to obtain the solid. The solid washed with aqua solution 70 ml of 10% by weight of ethanol, and then subjected to vacuum drying. The yield of resultant solid was 74.25 g, and the presumptive rate of the proanthocyanidin to be carried was 5.7% by weight. A sample was prepared in the same manner as Example 1 except that to the cellulose acetate fiber was added 40% by weight of the above-mentioned active carbon instead of the proanthocyanidin, and the radical capturing rate was measured. As a result, the radical capturing rate was 73%.

Example 7

Twenty-five grams (25 g) of a grape pip extract (Gravinol N) was dissolved in aqua solution 700 ml of 10% (v/v) ethanol. To the solution was added 70 g of an active carbon (manufactured by Takeda Chemical Industries, Ltd., active carbon "SHIRASAGI"), and the mixture was stirred for one whole day and night at room temperature. The mixture was subjected to filtration with suction by a glass filter to collect the active carbon, and the active carbon washed with 70 ml of 10% (v/v) ethanol. The active carbon was subjected to drying for 2 days under reduced pressure to obtain a grape pip extract-added (or -adsorbed) active carbon. The proanthocyanidin content in the filtrate and the washing solution was measured, and the amount of proanthocyanidin added to the active carbon was calculated backward, as a result it was found that 6.2% by weight of the proanthocyanidin relative to the active carbon was added.

A sample was prepared in the same manner as Example 1 except that to the cellulose acetate fiber was added 10% by weight of the grape pip extract-added active carbon prepared as mentioned above, and the radical capturing rate was measured. The results are shown in Table 4.

Example 8

A sample was prepared in the same manner as Example 1 except that on the tow was sprinkled a grape pip extract (Gravinol N), instead of the proanthocyanidin (Gravinol S), in amount of 1.54% by weight of the extract relative to the cellulose acetate fiber, and the radical capturing rate was measured. The results are shown in Table 4.

Comparative Example 9

A sample was prepared in the same manner as Comparative Example 2 except that the amount of the active carbon to be added was 10% by weight, and the radical capturing rate was measured. The results are shown in Table 4.

TABLE 4

| | Radical capturing agent | Radical capturing rate |
|---|---|---|
| Example 7 | grape pip extract (Gravinol N)-added active carbon | 83% |
| Example 8 | grape pip extract (Gravinol N) | 9% |
| Comparative Example 9 | active carbon | 52% |

As apparent from the results in Table 4, the grape pip extract-added active carbon used in Example 7 has good radical capturing effect. Moreover, even when each of the grape pip extract and the active carbon was individually added to the filter, it was admitted that a certain radical capturing effect was obtained. However, the radical capturing effect in Example 7 is larger than the total effect of the radical capturing effect in Example 8 (the same amount of the grape pip extract as that used in Example 7) and the radical capturing effect in Comparative Example 9 (the almost same amount of the active carbon as Example 7 was used). Therefore, the effect of the grape pip extract-added active carbon in Example 7 shows not simple arithmetic effect of the grape pip extract and the active carbon, but multiplier effect of the grape pip extract and the active carbon.

The invention claimed is:

1. A cigarette filter comprising a grape proanthocyanidin, wherein at least 70% by weight of the grape proanthocyanidin has a molecular weight of 5,000 g/mol or more.

2. The cigarette filter according to claim 1, wherein the proanthocyanidin is represented by the following formula (I):

(I)

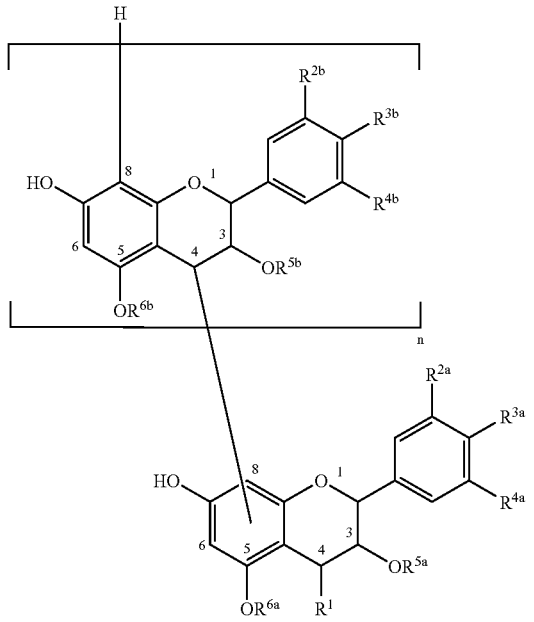

wherein $R^1$ represents hydrogen atom or hydroxyl group; $R^{2a}$, $R^{2b}$, $R^{4a}$ and $R^{4b}$ each independently represents hydrogen atom, hydroxyl group or a $C_{1-4}$ alkoxy group; $R^{3a}$ and $R^{3b}$ each independently represents hydroxyl group or a $C_{1-4}$ alkoxy group; $R^{5a}$, $R^{5b}$, $R^{6a}$ and $R^{6b}$ each independently represents hydrogen atom or an ester residue; and n represents an integer of not less than 1.

3. The cigarette filter according to claim 2, wherein, in the formula (I), $R^1$ represents hydrogen atom;

$R^{2a}$, $R^{2b}$, $R^{4a}$ and $R^{4b}$ each independently represents hydrogen atom, hydroxyl group or methoxy group;

$R^{3a}$ and $R^{3b}$ each independently represents hydroxyl group or methoxy group; and $R^{5a}$, $R^{5b}$, $R^{6a}$ and $R^{6b}$ each independently represents hydrogen atom, galloyl group or a glycopyranosyl group.

4. The cigarette filter according to claim 1, which comprises a porous material supporting or carrying the proanthocyanidin.

5. The cigarette filter according to claim 4, wherein the porous material comprises an active carbon.

6. The cigarette filter according to claim 4, wherein 0.1 to 50 parts by weight of the proanthocyanidin is supported or carried on 100 parts by weight of the porous material.

7. The cigarette filter according to claim 1, wherein the proanthocyanidin comprises an extract from at least one member selected a grape seed or pip, a grape rind or pericarp and squeezed dregs of a grape fruit.

8. The cigarette filter according to claim 1, wherein the content of the proanthocyanidin is 0.1 to 50 parts by weight relative to 100 parts by weight of the cigarette filter.

9. The cigarette filter according to claim 1, wherein an amount of a proanthocyanidin-carrying porous material is 0.1 to 25 parts by weight in terms of a proanthocyanidin relative to 100 parts by weight of the cigarette filter.

10. The cigarette filter according to claim 1, wherein an efficiency of capturing a radical in tobacco smoke is 30% or more when tobacco smoke is passed through the cigarette filter at a rate of air flow of 17.5 ml/second.

11. The cigarette filter according to claim 1, wherein the cigarette filter comprises at least one member selected from the group consisting of a cellulose fiber, a cellulose ester fiber and a polypropylene fiber.

12. The cigarette filter according to claim 1, wherein the cigarette filter comprises a cellulose acetate fiber.

13. A method for reducing or eliminating a tar component and/or a free radical component from tobacco smoke, said method comprising:

bringing the tobacco smoke into contact with a grape proanthocyanidin, wherein at least 70% by weight of the grape proanthocyanidin has a molecular weight of 5,000 g/mol or more.

14. The cigarette filter according to claim 1, wherein a ratio of eliminating tar relative to nicotine in tobacco smoke (filtration rate of tar/filtration rate of nicotine) is not less than 1.2.

* * * * *